US011565732B1

(12) United States Patent
Fornaci et al.

(10) Patent No.: US 11,565,732 B1
(45) Date of Patent: Jan. 31, 2023

(54) NON-CONDUCTIVE TRAIN TRIP ASSEMBLY

(71) Applicant: Hafco Foundry and Machine Company, Inc., Midland Park, NJ (US)

(72) Inventors: William H. Fornaci, Midland Park, NJ (US); Brett Hammond, Bloomfield, NJ (US)

(73) Assignee: Hafco Foundry and Machine Company, Inc., Midland Park, NJ (US)

( * ) Notice: Subject to any disclaimer, the term of this patent is extended or adjusted under 35 U.S.C. 154(b) by 344 days.

(21) Appl. No.: 16/859,586

(22) Filed: Apr. 27, 2020

(51) Int. Cl.
*B61L 3/04* (2006.01)
*B61L 23/06* (2006.01)

(52) U.S. Cl.
CPC ..... *B61L 3/04* (2013.01)

(58) Field of Classification Search
CPC ..... B61L 3/04
See application file for complete search history.

(56) References Cited

U.S. PATENT DOCUMENTS 8,061,662 B1 * 11/2011 Bartek ..... B61L 23/06 246/204

* cited by examiner

*Primary Examiner* — Adam D Tissot
(74) *Attorney, Agent, or Firm* — Pryor Cashman LLP

(57) ABSTRACT

A train trip assembly for automatically stopping a train is substantially composed of non-conductive material. The train trip assembly includes a trip arm that activates an actuator on a train moving along a track, which in turn causes a braking system on the train to automatically stop the train. The train trip assembly also includes a base including a clamp, which permits the train trip assembly to be secured to the track.

20 Claims, 13 Drawing Sheets

NON-CONDUCTIVE TRAIN TRIP ASSEMBLY

TECHNICAL FIELD

The present application relates to a train trip assembly for automatically stopping a train on a track, particularly a train trip assembly composed substantially of non-conductive material, such as fiberglass.

BACKGROUND

In modern railway systems, constant maintenance of the rail lines is an important aspect of maintaining the smooth operation of railways. With the rise of mass transit commuting, which supports millions of passengers each day, maintenance becomes especially important for providing long lengths of service with minimal delays in train arrival and departure times. Maintenance workers may be deployed whenever a track section is to be repaired or upgraded. Because maintenance workers work on track sections that are actively used by trains, they are susceptible to accidents in which trains unexpectedly travel along a track section currently under maintenance. One method for preventing accidents is through the use of train trips. Train trips provide a safety mechanism to automatically stop trains before they enter a work area. However, conventional train trips are often unwieldy and heavy. As such, there remains a need for more convenient train trips.

SUMMARY

In general, in one aspect, exemplary embodiments of the present application provide a train trip assembly for stopping a train comprising a substantially non-conductive trip arm and a substantially non-conductive base, the trip arm configured to contact an actuator of the train moving along a track, and the base including a clamp to secure the assembly to the track. Implementations of the various exemplary embodiment of the present application may include one or more of the following features. The trip arm includes a first elongated member and a second elongated member having a first end attached to the first elongated member. The trip arm includes a connector attached to a second end of the second elongated member and attached to the base. The first elongated member includes reflective material disposed thereon. The base further includes a first cavity configured to receive a first portion of the track, and a first opening having a first open end and a second closed end. The clamp comprises a fastener capable of being secured to the base by the first opening, a slider having a second cavity to receive a second portion of the track and an aperture that permits the slider to be secured to the fastener such that the slider is capable of moving along a longitudinal axis of the fastener and an adjuster for moving the fastener into or out of the first opening of the base. The train trip assembly is secured to the track by disposing a first portion of the track into the first cavity of the base and adjusting the fastener such that the second cavity of the slider receives the second portion of the track and thereby locks the assembly to the track. The fastener includes an external threaded surface and the first opening of the base includes an internal threaded surface configured to interlock with the external threaded surface. The rotation of the fastener in a first direction allows the fastener to be inserted further into the first opening and rotation of the fastener in a second direction allows the fastener to be withdrawn from the first opening.

In general, in one aspect, exemplary embodiments of the present application provide a method for automatically stopping a train moving along a track, the method comprising: providing a train trip assembly comprising a substantially non-conductive trip arm and a substantially non-conductive base, the trip arm configured to contact an actuator of a train moving along the track to stop the train, and the base including a clamp for securing the assembly to the track, and securing the train trip assembly to the track. Implementations of the various exemplary embodiment of the present application may include one or more of the following features. The trip arm includes a first elongated member and a second elongated member having a first end attached to the first elongated member. The trip arm includes a connector attached to a second end of the second elongated member and attached to the base. The first elongated member includes reflective material disposed thereon. The base further includes a first cavity configured to receive a first portion of the track, and a first opening having a first open end and a second closed end. The clamp comprises a fastener capable of being secured to the base by the first opening, a slider having a second cavity to receive a second portion of the track and an aperture that permits the slider to be secured to the fastener such that the slider is capable of moving along a longitudinal axis of the fastener and an adjuster for moving the fastener into or out of the first opening of the base. The step of securing the train trip assembly to the track comprises: disposing a first portion of the track into the first cavity of the base, and operating the adjuster to adjust the fastener such that the second cavity of the slider receives the second portion of the track, thereby locking the train trip assembly to the track. The fastener includes an external threaded surface and the first opening of the base includes an internal threaded surface configured to interlock with the external threaded surface. The rotation of the fastener in a first direction allows the fastener to be inserted further into the first opening and rotation of the fastener in a second direction allows the fastener to be withdrawn from the first opening.

BRIEF DESCRIPTION OF THE DRAWINGS

The aforementioned and other aspects, features and advantages can be more readily understood from the following detailed description with reference to the accompanying drawings wherein.

DETAILED DESCRIPTION OF THE PREFERRED EMBODIMENTS

Figure 1:
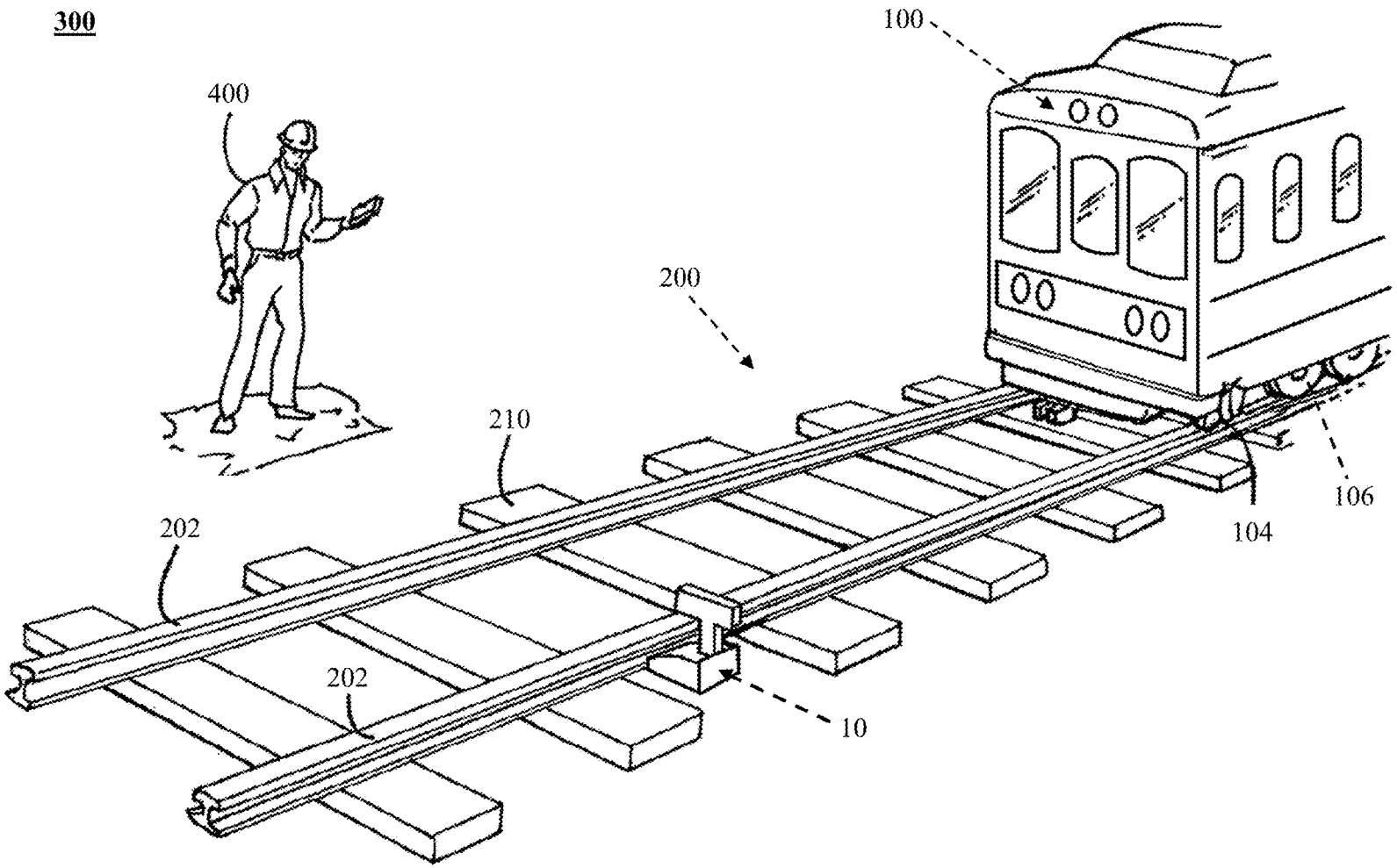
FIG. 1 shows a system in which maintenance workers are working on a section of a track that is currently being used by a train, according to an embodiment of the present invention.

In describing preferred embodiments illustrated in the drawings, specific terminology is employed herein for the sake of clarity. However, this disclosure is not intended to be limited to the specific terminology so selected and it is to be understood that each specific element includes all technical equivalents that operate in a similar manner. In addition, a detailed description of known functions and configurations is omitted from this specification when it may obscure the inventive aspects described herein.

Figure 2:
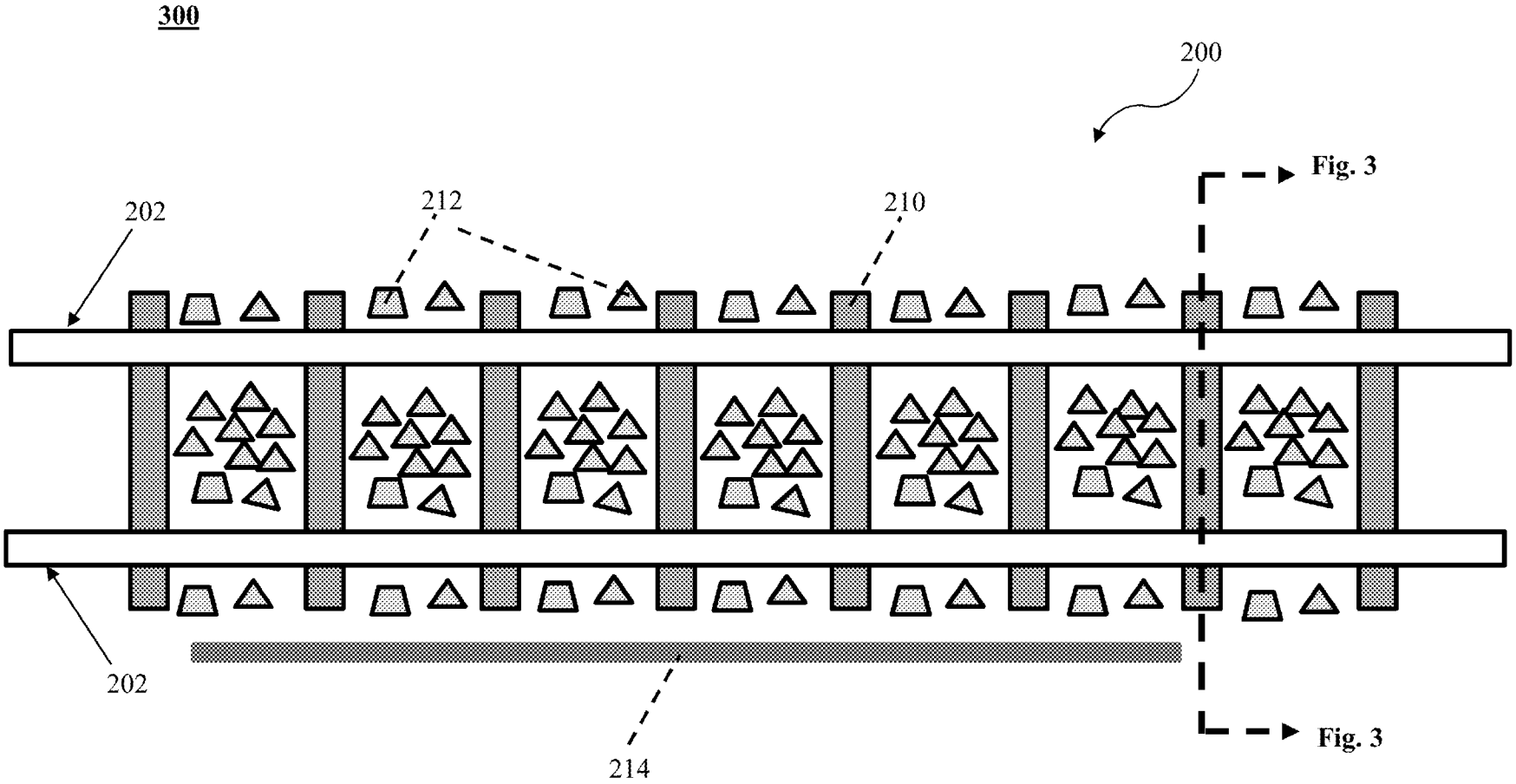
FIG. 2 shows an example of a section of train track, according to an embodiment of the present invention.
Figure 3:
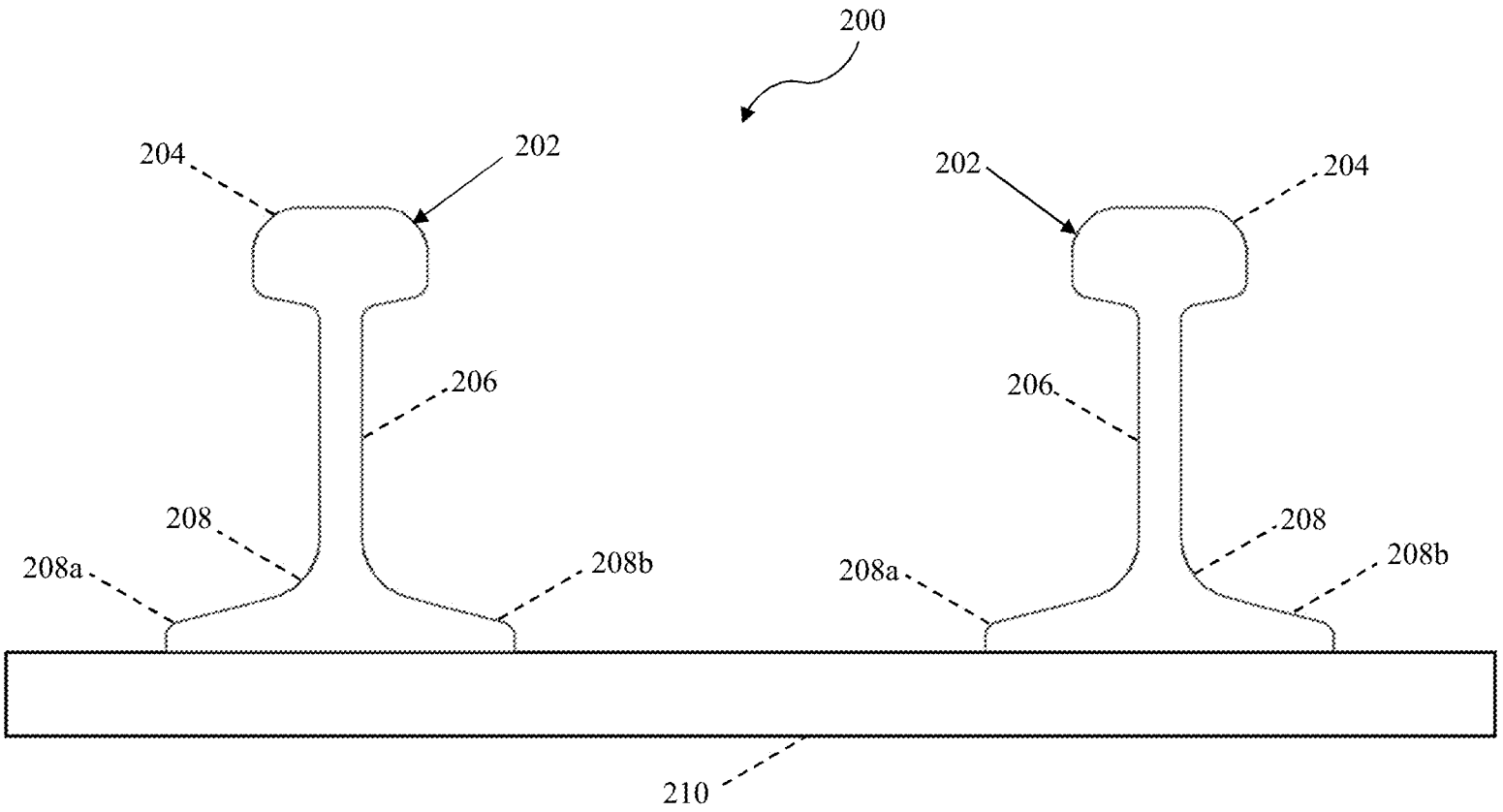
FIG. 3 shows a cross-section of the track, according to the embodiment illustrated in FIG. 2.

FIGS. 1 and 2 illustrate a scenario of an area along a railway or train line. Such area includes a track 200. The track 200 may include one or more rails 202, which support wheels 106 of a train 100 so as to guide the train 100 along the track 200. As shown in FIG. 3, which is a cross-section of the track 200 in FIG. 2, each of the rails 202 may have a rail profile, i.e. cross-section of rails 202, that may one of the following types, e.g., strap rail, plate rail, bridge rail, Barlow rail, flat bottomed rail, flanged T rail, Vignoles rail, double-headed rail, bullhead rail, grooved rail, girder guard rail and block rail. More specifically, a rail profile of the track 200, which includes a head 204, a web 206 and a foot 208. The head 204 directly contacts the wheels 106 and supports the wheels 106 of the train 100. The web 206 connects the head 204 to the foot 208. The web 206 includes a thinner cross-section than a cross-section of the head 204 or the foot 208. The foot 208 contacts the surface providing support for the rails 202. For example, such surface may include the ground, track ballasts, track ties, concrete or metal. For example, a width of the cross-section of the foot 208 is wider than a width of the cross-sections of both the head 204 and the web 206. Such structure is due to the fact that the foot 208 provides support for the rail 202 as well as the train 100 moving along the rail 202. The foot 208 includes a first portion 208*a* and a second portion 208*b*. Each of the first portion 208*a* and a second portion 208*b* may include a smooth flat surface that contacts the ground, track ballasts, track ties, concrete or metal. However, a top surface of the first and second portions 208*a*, 208*b* may be angled with respect to the bottom portion of first and second portions 208*a*, 208*b*.

Further, the track 200 may also include one or more track ties 210, which provide support for the rails 202 by holding the rails 202 upright and spaced according to the correct gauge. For example, the track ties 210 may be laid perpendicularly to the rails 202 such that the track ties 210 are attached to each foot 208 of the rails 202. The track ties help maintain the rail gauge, i.e. the correct width between the rails 202. The rails 202 and track ties 210 may also lay upon a layer of track ballast 212, which is utilized to bear loads from the rails 202 (via the track ties 210) and to hold the rails 202 in place as trains roll over them. The track ballast 212 may include a plurality of crushed stones that each have angular faces to assist the crushed stones in interlocking with each other, thereby enhancing the strength of the track ballast 212. In an exemplary embodiment, the track 200 may also include a third rail 214, which can provide electric power to trains running on the track 200. Such third rail 214 may be placed alongside in parallel with the rails 202, as shown in FIG. 2. It should be noted that the third rail 214 is always live, i.e. transmitting electricity. As such, contact with the third rail 214 may be extremely dangerous.

The track 200 may also include a track maintenance section 300 in which maintenance workers 400 are currently performing work, e.g., repairing and/or upgrading, on the section 202. In such a scenario, the maintenance section 300 and/or a portion of the track 200 leading to the maintenance section 300 in either direction may be closed off to trains to prevent injury to the workers 400. However, even closing off portions of the track 200 may not necessarily guarantee that the workers 300 will be safe; a train 100 may still be accidentally traveling along the track 200. Such unexpected incident may occur due to, for example, an error at a railroad track switch which causes the train 100 to travel on the track 200 towards the maintenance section 300 instead of an appropriate intended track.

In this case, a train conductor driving the train 100 may activate, e.g., via a button or lever, a brake system 102 (not shown) included on the train 100 once the maintenance section 300 and/or workers 400 visually appear before the train conductor. In an example, the maintenance section 202 may include a visual indicator, e.g., sign, that notifies the train conductor that he or she is entering a maintenance section, e.g., 300. Nevertheless, it would not be prudent to rely on the assumption that the train conductor is capable of stopping the train 100 in time before the train 200 enters the section 300 or collides with the workers 400. For example, if the train 100 were an underground subway system, the darkness may impede the vision of the train conductor, even with train headlights. As such, if the train 100 is traveling at a fast speed, the train conductor may not be able to activate the brake system 102 in time.

As such, a train trip assembly 10 may be provided along the track 200 to automatically halt or stop the train 100 before it enters the section 300. When the train 100 passes by the train trip 10, the train trip 10 activates an actuator 104 on the train 100. The actuator 104 is disposed external to a body of the train 100, and is connected to the brake system 102 on the train 100. As such, when the actuator 104 is activated, the actuator 104 causes the brake system 102 to activate, thereby halting the train 100 before it causes an accident. In one exemplary embodiment, the actuator 104 may be a mechanical device. In such a case, the actuator 104 physically collides with the train trip 10. Force from the collision causes movement in the actuator 104, i.e. activating, which in turn activates the brake system 102 for halting the train 100. For example, the actuator 104 may be operate via a pneumatic system. In another exemplary embodiment, the actuator 104 may be an electrical device. In such a case, the actuator 104 can physically touch or be at close distance to the train trip 10 to activate. After the actuator 104 physically touches or comes into close contact with the train trip 10, an electrical signal is sent from the train trip 10 to the actuator 104, which in turn sends a control signal or forwards the electrical signal to the brake system 102. In response to the electrical or control signal, the brake system 102 activates to stop the train 100. In the case in which the actuator 104 activates via an electrical signal, the train trip 10 may be connected to a power supply or the third rail 214, which provides energy to the train trip 10 for generating an electrical signal. It should be noted that, as discussed infra, the train trip 10 has a structure that is configured to be reusable (further explained below), such that collisions with or physically touching the actuator 104 does not damage the entire train trip 10. Likewise, the actuator 104 is reusable as well, and the collisions with or physically touching the train trip 10 may not damage the actuator 104. In addition, both the actuator 104 and the train trip 10 may have moving and/or non-moving parts.

Figure 4:
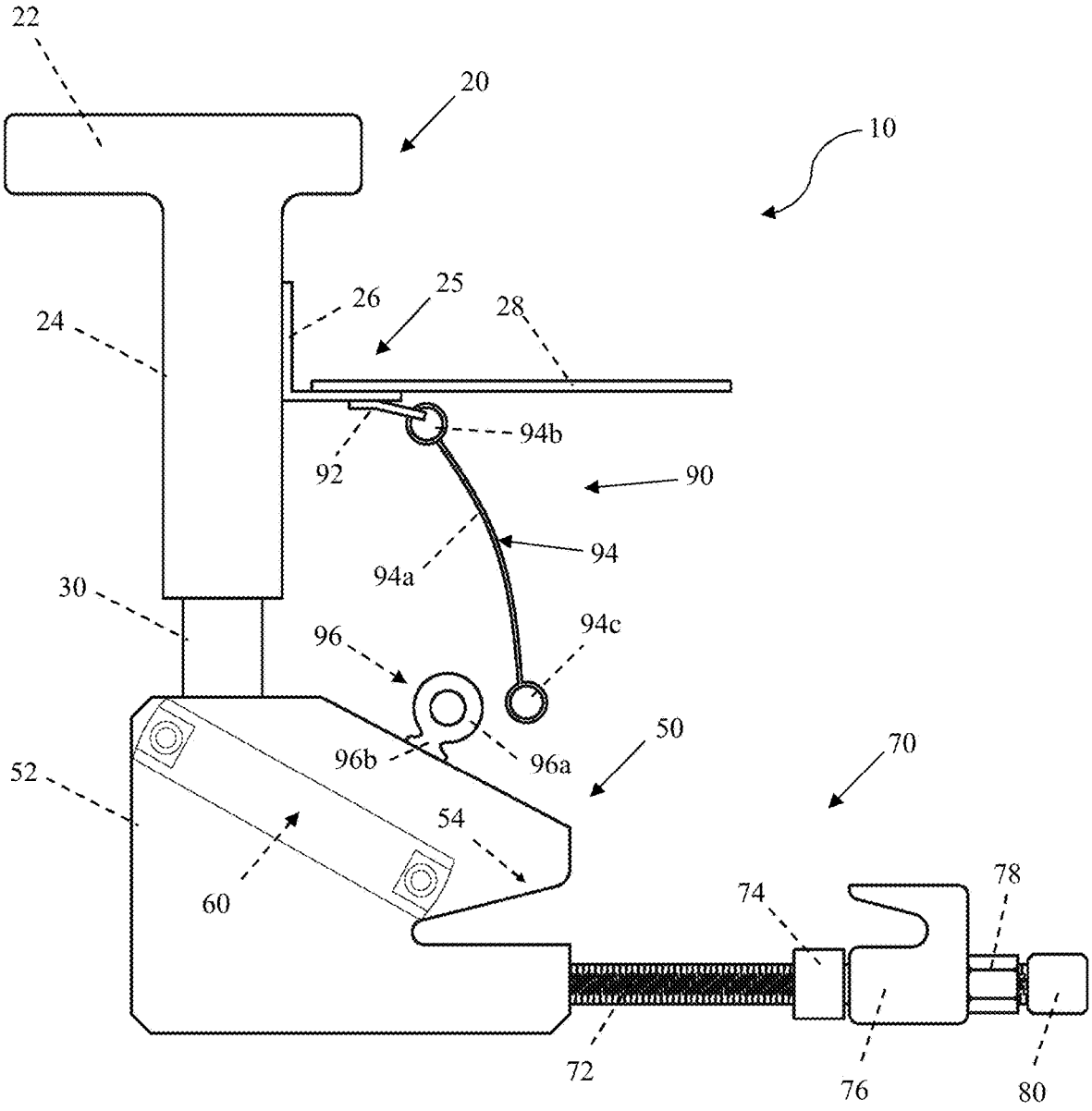
FIG. 4 shows a front view of a train trip assembly, according to an embodiment of the present invention.

FIG. 4 illustrates an embodiment of the train trip assembly 10. The train trip assembly 10 may be composed substantially of non-conductive material. Non-conductive material is material that substantially prevents the flow of electric current such that the non-conductive material is not capable of conducting electricity. For example, such non-conductive material may include fiberglass. Fiberglass is a strong lightweight material. Fiberglass can also be a fiber-reinforced plastic using glass fiber. Fiberglass is stronger than many metals, is non-magnetic, is non-conductive, is transparent to electromagnetic radiation, can be molded into complex shapes, is corrosion-resistant, and is chemically inert under many circumstances. An example of a glass fiber used in the production of fiber glass includes E-glass, which is alumino-borosilicate glass with less than 1% w/w alkali oxides. Other glass fibers used are A-glass (Alkali-lime glass with little or no boron oxide), E-CR-glass (Electrical/Chemical Resistance; alumino-lime silicate with less than 1% w/w alkali oxides, with high acid resistance), C-glass (alkali-lime glass with high boron oxide content, used for glass staple fibers and insulation), D-glass (borosilicate glass, named for its low Dielectric constant), R-glass (alumino silicate glass without MgO and CaO with high mechanical requirements as Reinforcement), and S-glass (alumino silicate glass without CaO but with high MgO content with high tensile strength). In another example, the glasses used in producing fiberglass may include silica or silicate and small amounts of oxides of calcium, magnesium and boron. The properties of fiberglass provide many advantages to the train trip 10. The train trip 10 becomes lightweight and easy to carry. Further, the train trip 10 can prevent electrocution resulting from being disposed near a third rail, e.g., 214. In addition, the train trip 10 may be more durable. In yet another example, the fiberglass for the train trip assembly 10 may be composed substantially of FR-4/G10 Fiberglass. FR-4/G10 Fiberglass is a composite material that consists of glass fabric, electrical grade epoxy resin. The material is extremely strong and stiff, has a low coefficient of thermal expansion, and outstanding electrical properties. FR-4/G10 Fiberglass can be used for the train trip assembly as an insulator and can provide benefits such as outstanding strength, stiffness, and excellent creep resistance for the train trip assembly 10.

Figure 5A:
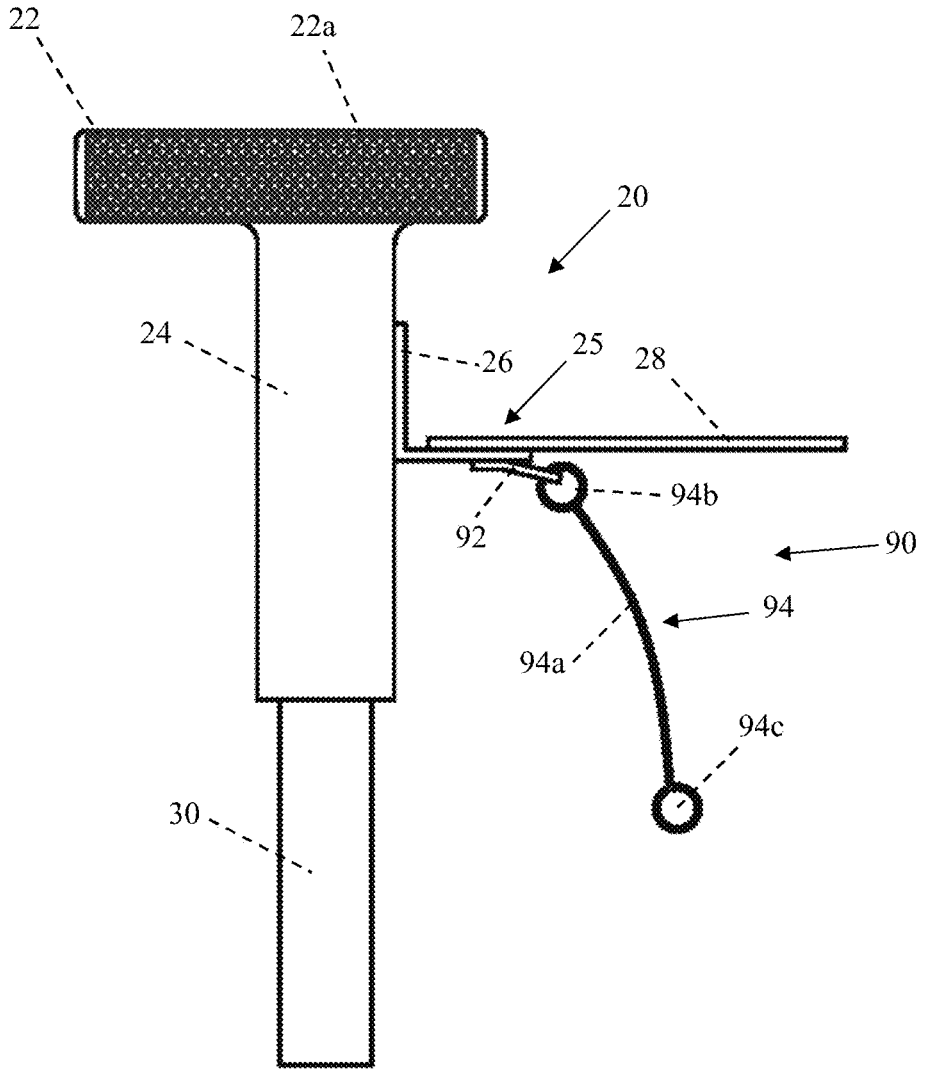
FIG. 5A shows a front view of a trip arm of the train trip assembly, according to an embodiment of the present invention.
Figure 5D:
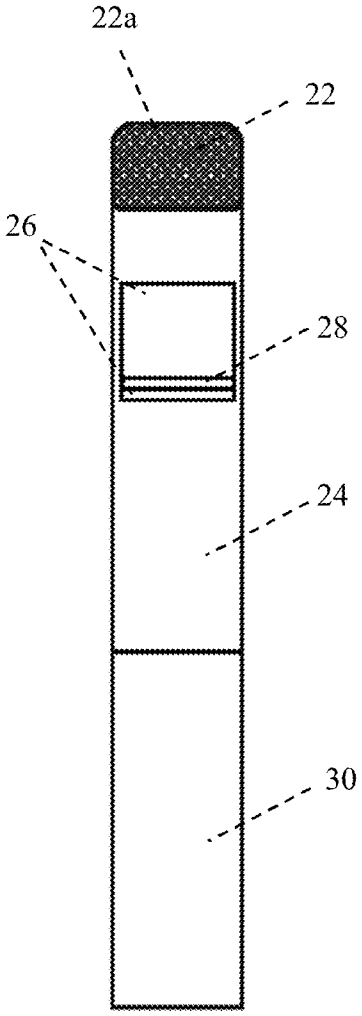
FIG. 5D shows a right-side view of the trip arm of the train trip assembly, according to an embodiment of the present invention.
Figure 5C:
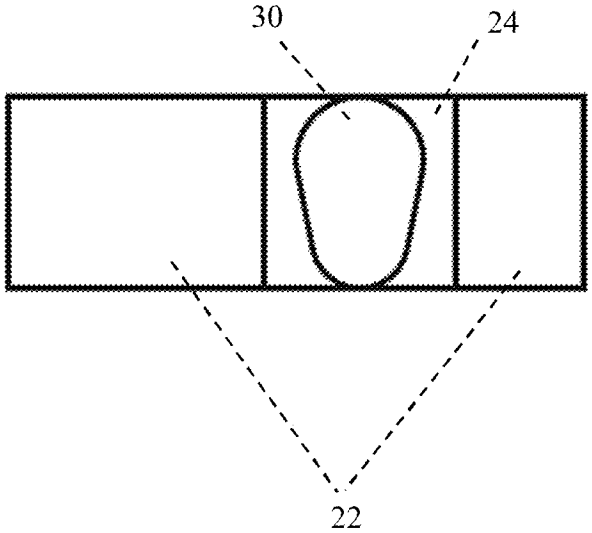
FIG. 5C shows a bottom view of the trip arm of the train trip assembly, according to an embodiment of the present invention.
Figure 5B:
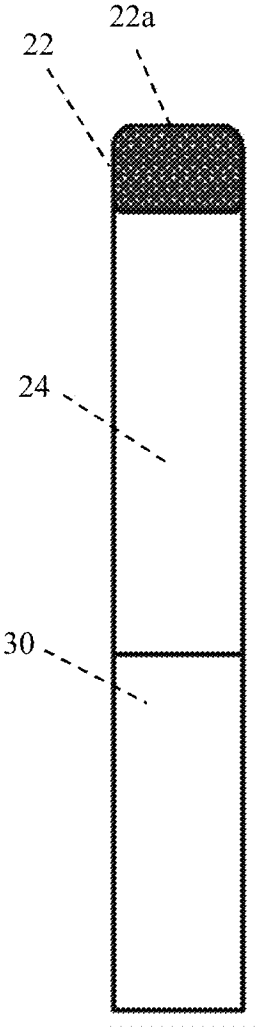
FIG. 5B shows a left-side view of the trip arm of the train trip assembly, according to an embodiment of the present invention.

As illustrated in FIG. 4, the train trip assembly 10 includes a trip arm 20 and a base 50. FIG. 5A shows a front view of the trip arm 20, FIG. 5B shows a left side view of the trip arm 20, FIG. 5C shows a bottom view of the trip arm 20 and FIG. 5D shows a right side view of trip arm 20. The trip arm 20 includes a first elongated member 22, a second elongated member 24 and a connector 30. In an exemplary embodiment first member 22 and the second member 24 are rectangular bodies having smooth edges. The first member 22 is attached to a first end of the second member 24 such that the first member 22 is perpendicular to the second member 24. For example, a mid-section of the first member 22 is attached to the first end of the second member 24. In addition, as shown in FIGS. 5A, 5B and 5D, the trip arm 20 may include reflective material 22*a* on all visible sides of the first elongated member 22 of the trip arm 20. In other words, the reflective material 22*a* is disposed substantially on the front surface of the first elongated member 22, as shown in FIG. 5A, on the sides of the first elongated member 22*a* as shown in FIGS. 5B and 5D, as well as on the top and back of the first elongated member 22*a* (not shown).

The reflective material 22*a* may include reflective glass beads, microprisms or encapsulated lenses sealed onto a fabric or plastic substrate. For example, such reflective material may also be non-conductive. Such reflective material 22*a* may be used to increase the conspicuity of the train trip 10 by reflecting light from an approaching train's, e.g., train 100, headlights. In the case that the train conductor is able to notice the light reflecting off the reflective material 22*a*, the train conductor may realize that such light is coming from a train trip 10. Thus, the train conductor may be aware that the train is heading into a work zone, e.g., 300, and may apply the brakes on the train before the train reaches the train trip 10. Further, by disposing as much reflective material on the trip arm 20 as possible, e.g., on all visible sides of the first elongated member 22, the likelihood that the reflective material reflects light from a train's headlight increases, thereby raising the probability that the conductor of the train sees the reflection, recognizes that there is a train trip, e.g., 10, 11, ahead (and therefore has entered a maintenance area), and stops the train before any accidents can occur.

The connector 30 is attached to a second end of the second member 24. Like the first and second members 22, 24, the connector 30 may be elongated. As shown in FIG. 5D, the connector 30 may include a cross-section that has an oval-shape or having the shape of an egg. The second elongated member 24 includes an indicator arm 25 attached thereon. The indicator arm 25 includes a first indicator member 26 and a second indicator member 28. The first indicator member 26 is attached to the second elongated member 24. In turn, the second indicator member 28 is attached to the first indicator member 28. The indicator arm 25 is configured to maintain the vertical position of the train trip 10, based on the height of the rail 202. In other words, the indicator arm 25 may assist in balancing the train trip 10 by using the rail 202. In addition, the indicator arm 25 is capable of being used with different rail sizes, e.g., rails 202 or 242. Thus, in one exemplary embodiment, the indicator arm 25 can be removably attached from the second elongated member 24. For example, the first indicator member 24 may be attached to the second elongated member 24 via a fastener, such as a screw. In another exemplary embodiment, the first indicator member 26 can be configured to adjust, such that the indicator arm 25 can be used with different rail sizes, e.g., 202 or 242. Further, the indicator arm 25 also is configured to provide physical evidence that a train ran past the train trip 10. For example, when the train, e.g., 100, runs past the train trip 10, the wheels 106 contact the indicator arm 25. Because the second indicator member 28 is laid on the rail 202, the second indicator member 28 is squeezed between the wheel 106 and the rail 202. The weight of the train 100 causes the second indicator member 28 to be physically changed, i.e., flattened. Thus, the physical change of the second indicator member 28 provides confirmation that the train 100 had run past the train trip 10. Thus, the indicator arm 25 can be used to provide additional proof that the train 100 ran past the train trip 10. It should be also noted that, when a train does indeed cause the second indicator member 28 to be flattened, the train trip 10 is still reusable. For example, it is sufficient to merely replace the trip arm 20 with a new trip arm 20, while leaving the base 50 intact and secured to the rail 202.

In addition, the trip arm 20 includes a locking mechanism 90 that secures the trip arm 20 to the base 50. For example, the trip arm 20 may not be permanently secured to the base 50, such that the trip arm 20 can be removed by disconnecting the trip arm 20 from the base 50. The locking mechanism 90 includes a coupling member 92 and a connecting member 94. The connecting member 94 includes a flexible member 94*a*, a first ring 94*b* and a second ring 94*c*. The flexible member 94*a* may, for example, be long and thin material, such as a cable, wire or rope. A first end of the flexible member 94*a* is connected to the first ring 94*b* and a second end of the flexible member 94*a* is connected to the second ring 94*c*. The coupling member 92 provides a removable connection between the trip arm 20 and the locking mechanism 90. More specifically, a first end of the coupling member 92 is attached to a bottom surface of the first indicator member 26 and a second end of the coupling member 92 is connected to the first ring 94*b*. In an exemplary embodiment, the first ring 94*b* may include a circle cotter, e.g., split ring or a cotter ring, such that the coupling member 92 is capable of receiving such circle cotter of the first ring 94*bc*. Thus, the first ring 94*b* can be removably attached to the coupling member 92. It should be noted that the locking mechanism 90 may be composed substantially of non-conductive material, such as, for example, rubber or insulating plastic. More details on how the locking mechanism 90 secures the trip arm 20 to the base 50 are described below.

Figure 6A:
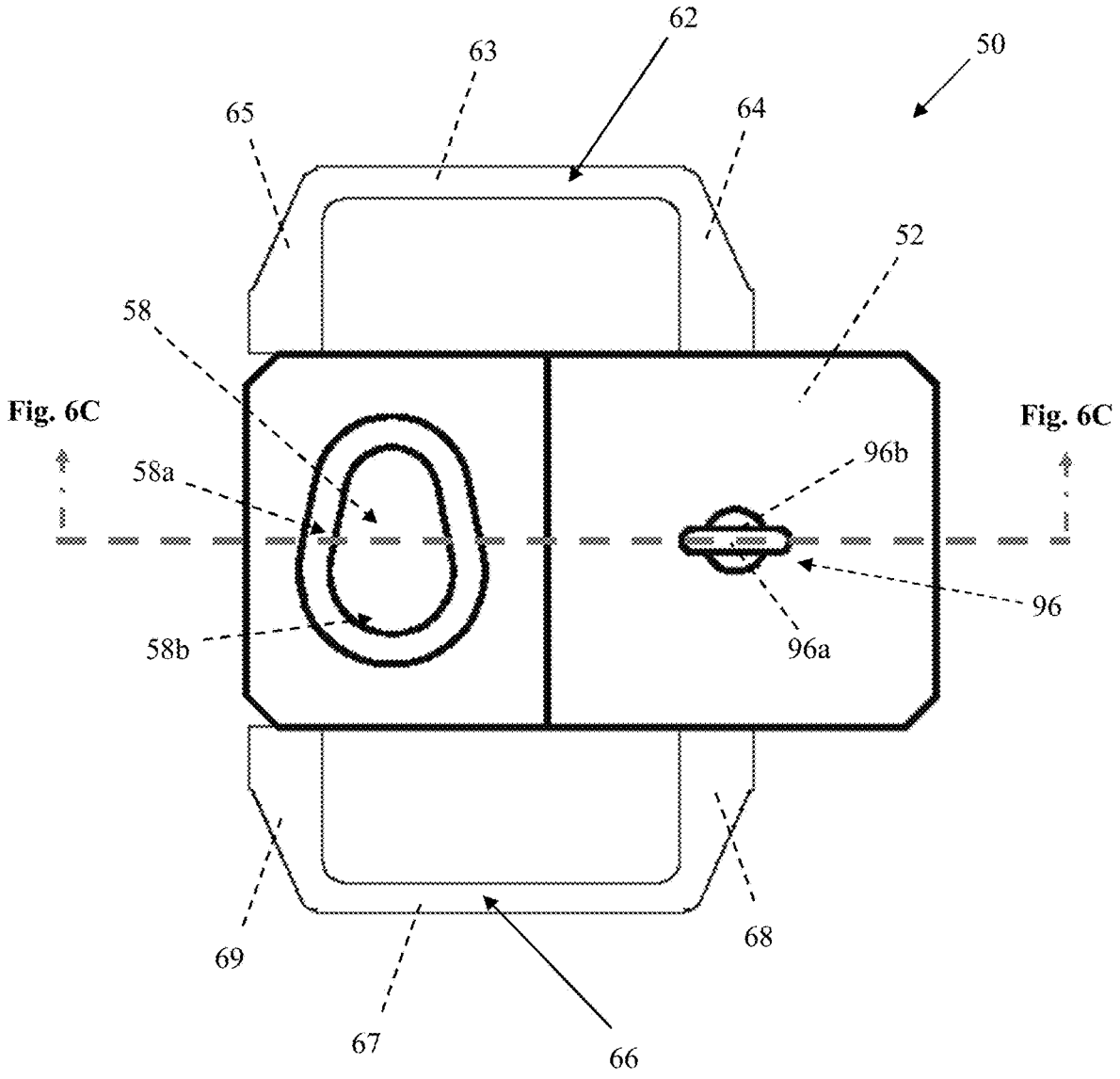
FIG. 6A shows a top view of the base of the train trip assembly, according to an embodiment of the present invention.
Figure 6B:
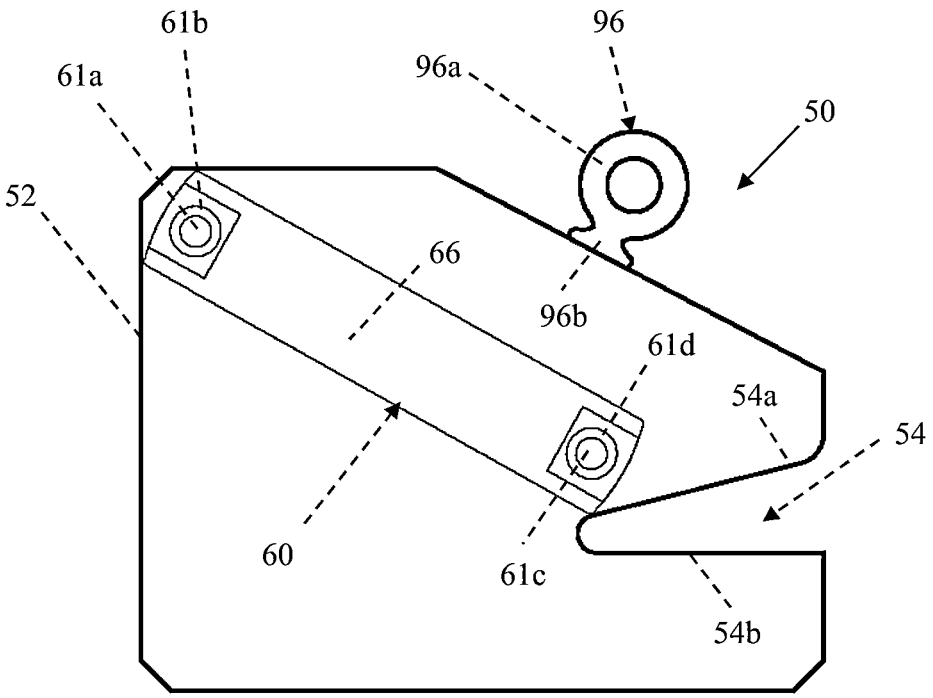
FIG. 6B shows a front view of the base of the train trip assembly, according to an embodiment of the present invention.
Figure 6C:
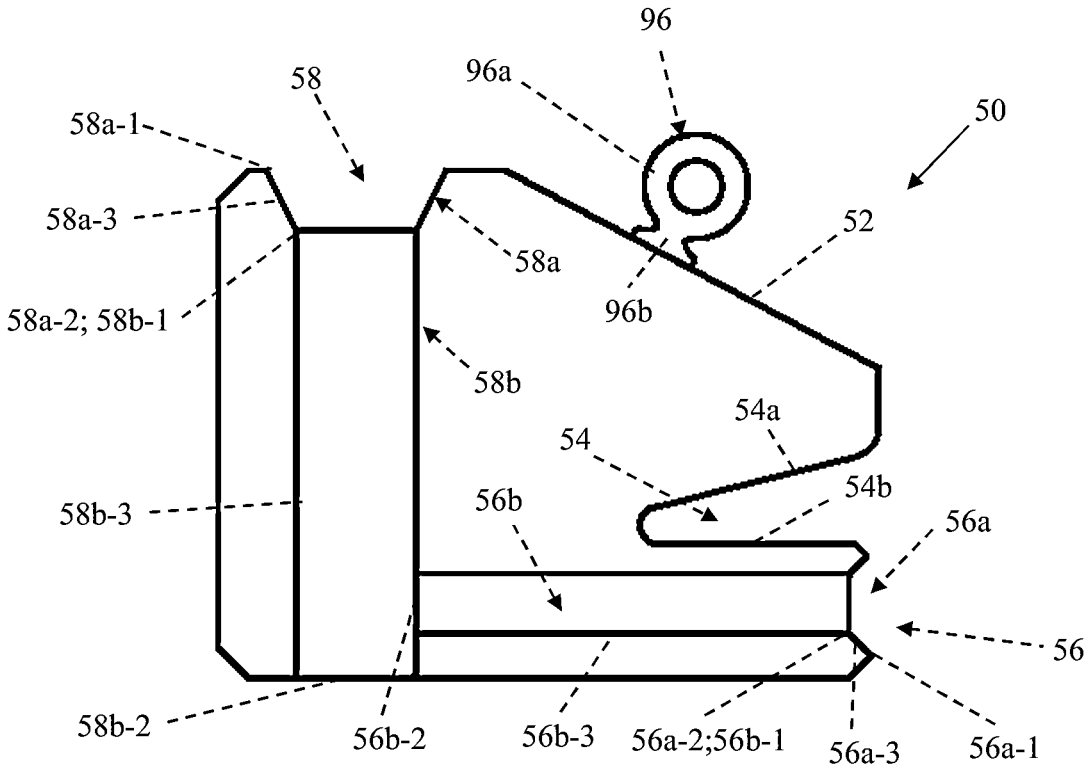
FIG. 6C shows a cross-section of the base of the train trip assembly, according to the embodiment illustrated in FIG. 6A.
Figure 6D:
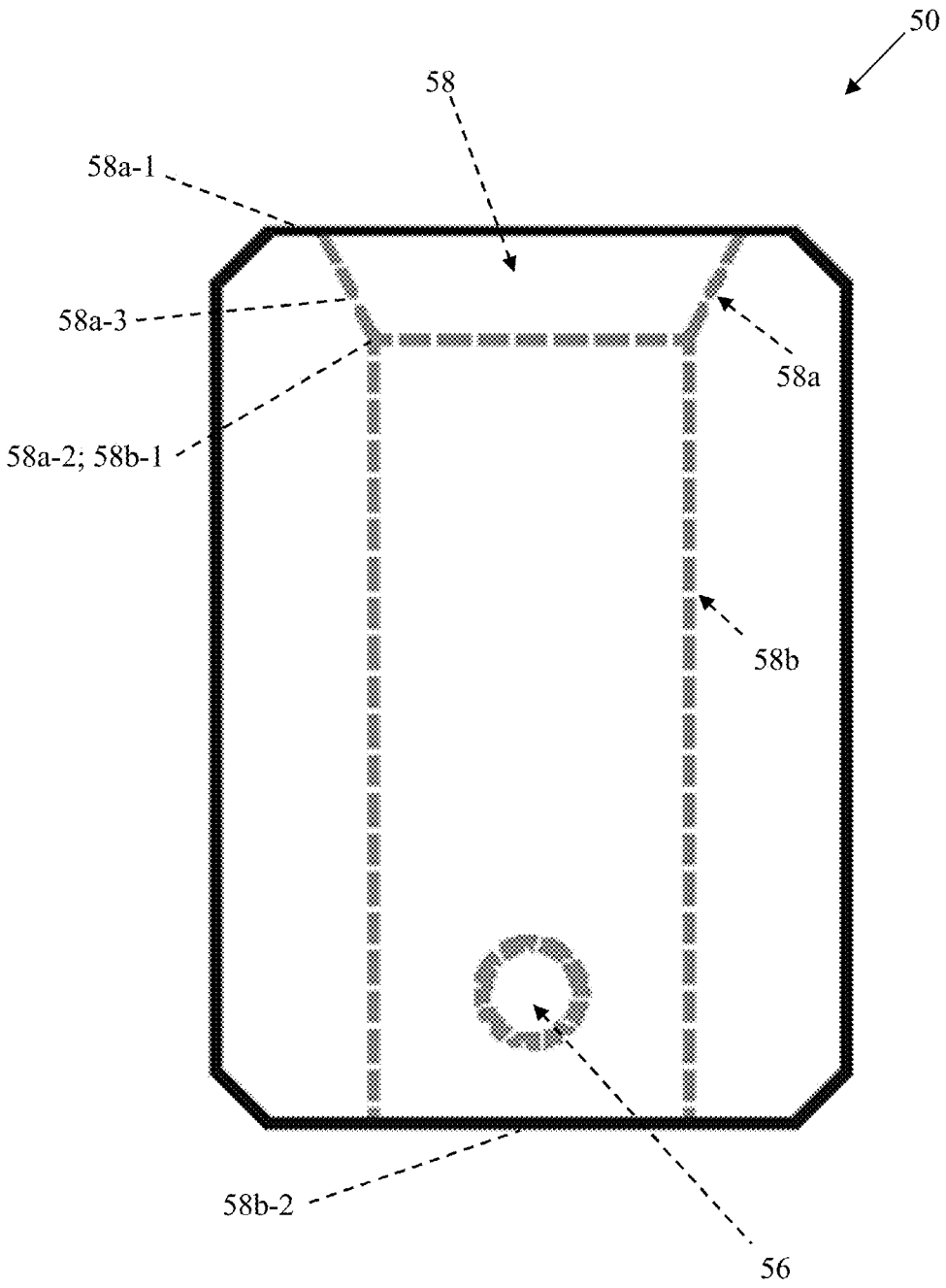
FIG. 6D shows a left side view of the base of the train trip assembly, according to an embodiment of the present invention.

FIG. 6A shows a top view of the base 50, FIG. 6B shows a front view of the base 50, FIG. 6C shows a cross-sectional view taken along the line illustrated in FIG. 6A, and FIG. 6D shows a left side view of the base 50, with the dotted lines representing internal features of the base 50. The base 50 is configured to secure the train trip 10 to one of the rails 202 on any portion of the track 200. The base 50 includes a base body 52, which in turn includes a cavity 54, a first opening 56 and a second opening 58. Attached to the body 52 are one or more handles 60. The cavity 54 includes a flat planar surface 54*a* and a sloped planar surface 54*b*. A first end of the flat surface 54*a* is connected to a first end of the sloped surface 54*b* such that an angle is formed between the flat surface 54*a* and the sloped surface 54*b*. For example, such angle may be between 10-20 degrees. Preferably, the angle is 14 degrees. Due to such configuration, the cavity 54 is able to receive the first portion 208*a* of the foot 208. Both the first opening 56 and the second opening 58 may include a blind-hole. In other words, both the first opening 56 and the second opening 58 may extend towards a specified depth without breaking through to the other side of the body 52.

The first opening 56 is disposed below the cavity 54 and includes a longitudinal axis that is perpendicular to a longitudinal axis of the second opening 58. The first opening 56 includes an internally threaded surface, e.g., female thread, such that the first opening 56 is capable of receiving, or interlocking with, an object having an external threaded surface, e.g., male thread. More specifically, the first opening 56 may have a first section 56*a* and a second section 56*b*. The first section 56*a* may also include a curved or circular cross-section. Further, the first section 56*a* includes a first end 56*a*-1 that is open and a second end 56*a*-2 that is connected to the second section 56*b*. An interior wall 56*a*-3 is connected between the first end 56*a*-land the second end 56*a*-2. As the interior wall 56*a*-3 extends from the first end 56*a*-1 to the second end 56-2, the interior wall 56*a*-1 tapers, such that the cross-section of the second opening 56 decreases in area. The second section 56*b* includes a first end 56*b*-1 that is connected to the second end 56*a*-2 of the first section 56*a* and a second end 56*b*-1 that is a closed end which is sealed by a wall, e.g., interior wall 58*a*-3. An interior wall 56*b*-3 is connected between the first end 56*b*-land the second end 56*b*-2. Like the first section 56*a*, the second section 56*b* may also include a curved or circular cross-section. In an exemplary embodiment, the cross-section of the second section 56*b* includes a uniform area such that the interior wall 56*b*-3 does not taper. In another exemplary embodiment, the first end 56*a*-1 of the first section 56*a* includes a cross-sectional area that is larger than the cross-sectional area of the second section 56*b*. In yet another exemplary embodiment, second end 56*b*-1 includes a cross-sectional area that is the same as the cross-sectional area of the second section 56*b*.

The second opening 58 is configured to receive the connector 30. The second opening 58 may have a first section 58*a* and a second section 58*b*. The first section 58*a* may also include a cross-section that has an oval-shape or having the shape of an egg. Further, the first section 58*a* includes a first end 58*a*-1 that is open and a second end 58*a*-2 that is connected to the second section 58*b*. An interior wall 58*a*-3 is connected between the first end 58*a*-land the second end 58*a*-2. As the interior wall 58*a*-3 extends from the first end 58*a*-1 to the second end 58-2, the interior wall 58*a*-3 tapers, such that the cross-section of the second opening 58 decreases in area. The second section 58*b* includes a first end 58*b*-1 that is connected to the second end 58*a*-2 of the first section 58*a* and a second end 58*b*-1 that is a closed end at a bottom of the body 52. An interior wall 58*b*-3 is connected between the first end 58*b*-land the second end 58*b*-2. Like the first section 58*a*, the second section 58*b* may also include a cross-section that has an oval-shape or having the shape of an egg. In an exemplary embodiment, the cross-section of the second section 58*b* includes a uniform area such that the interior wall 58*b*-3 does not taper. In another exemplary embodiment, the first end 58*a*-1 of the first section 58*a* includes a cross-sectional area that is larger than the cross-sectional area of the second section 58*b*. In yet another exemplary embodiment, second end 58*b*-1 includes a cross-sectional area that is the same as the cross-sectional area of the second section 58*b*. Such configuration, in which the cross-sections of the connector 30 and the second opening 58 are oval-shaped, prevents the trip arm 20 from rotating.

The handles 60 may be included on sides of the base 50, such that the handles assist a user in pressing the train trip 10 onto a surface supporting the train trip 10. The handle 60 includes a first handle portion 62 and a second handle portion 66. Each of the first and second handle portions 62 and 66 may include an aperture 61*a* and an aperture 61*b*. A fastener 61*b* may be used to secure the first and second handles 62 and 66 via the aperture 61*a*. Likewise, a fastener 61*d* may be used to secure the first and second handles 62 and 66 via the aperture 61*c*. The first handle portion 62 includes a first gripping portion 63, a first attachment member 64 and a second attachment member 65. Such first gripping portion 63 may be an elongated structure that allows a user to wrap his or her fingers (including thumb) of a first arm around the first gripping portion 63. The gripping portion 63 has a first end connected to a first end of the first attachment member 64 and a second end connected to a first end of the second attachment member 65. For example, the first gripping portion 63 may be connected in a substantially perpendicular manner to the first attachment member 64 and/or the second attachment member 65. The first attachment member 64 includes a second end that is connected to a first side of the body 52 of the base 50 via, e.g., the fastener 61*d*, at a first position. Such first position may be disposed above the flat planar surface 54*a* of the cavity 54. Further, the first attachment member 64 may extend away from the body 52, such that the first attachment member 64 tapers from the second end of the first attachment member 64 to the first end of the first attachment member 64. Likewise, the second attachment member 65 includes a second end that is connected to the body 52 of the base 50 via, e.g., the fastener 61*b*, at a second position. Such second position may be disposed above the first position. For example, the second attachment member 65 may extend away from the body 52, such that the second attachment member 65 tapers from the second end of the second attachment member 65 to the first end of the second attachment member 65. As a result of such configuration, the angle of the first handle portion 62 may be at an angle, e.g., 30 degrees, with respect to the bottom of the body 52.

The second handle portion 66 includes a second gripping portion 67, a third attachment member 68 and a second attachment member 69. Such second gripping portion 67 may be an elongated structure that allows a user to wrap his or her fingers (including thumb) of a second arm around the second gripping portion 67. The second gripping portion 67 has a first end connected to a first end of the third attachment member 68 and a second end connected to a first end of the fourth attachment member 69. For example, the second gripping portion 67 may be connected in a substantially perpendicular manner to the third attachment member 68 and/or the fourth attachment member 69. The third attachment member 68 includes a second end that is connected to a second side of the body 52 of the base 50 via, e.g., the fastener 61*d*, at a third position. Such second position may be disposed above the flat planar surface 54*a* of the cavity 54. The second side of the body 52 is opposite the first side of the body 52. For example, the third attachment member 68 may extend away from the body 52, such that the third attachment member 68 tapers from the second end of the third attachment member 68 to the first end of the third attachment member 68. Likewise, the fourth attachment member 69 includes a second end that is connected to the body 52 of the base 50 via, e.g., the fastener 61*b*, at a fourth position. Such fourth position may be disposed above the third position. For example, the fourth attachment member 646 may extend away from the body 52, such that the fourth attachment member 69 tapers from the second end of the fourth attachment member 69 to the first end of the fourth attachment member 69. As a result of such configuration, the angle of the second handle portion 66 may be at an angle, e.g., 30 degrees, with respect to the bottom of the body 52.

Due to such configuration in which the first handle portion 62 and the second handle portion 66 are both above the flat planar surface 54*a* of the cavity 54 with respect to the bottom end of the body 52, the first handle portion 62 and the second handle portion 66 are also disposed above the track ties 210, and, as such, do not interfere with the track ties 210. In other words, the securing the train trip 10 to the rail 202 may not cause the first handle portion 62 and the second handle portion 66 to make contact with or be blocked by the track ties 210. Indeed, even if the first handle portion 62 and the second handle portion 66 do make contact with one of the track ties 210, the track ties 210 support the first attachment member 64 and the third attachment member 68. Such configuration may alleviate scenarios in which each of the track ties 210 are disposed very close to each other.

The base 50 also includes a fastener 96 that cooperates with the locking mechanism 90 to secure the trip arm 20 to the base 50. As shown in FIGS. 4 and 6A-6C, the fastener 96 includes a base ring 92*a* and a support 92*b*. The base ring 92*a* is attached to the support 92*b*, which in turn is attached to the base 50. The support 96*b* upholds the base ring 96*a*. In an exemplary embodiment, the fastener 96 is composed entirely of fiberglass material, e.g., FR-4, G10 Fiberglass. The fastener 96 can be removably attached to the locking mechanism 90. More specifically, the second ring 94*c* may include a circle cotter, e.g., split ring or a cotter ring, such that the base ring 96*a* is capable of receiving such circle cotter of the second ring 94*c*. Thus, the second ring 94*c* can be removably attached to the base ring 96*a*. As such, the securing of the locking mechanism 90 to the fastener 96 causes the trip arm 20 to be attached to the base 50. It should be noted that the length of the flexible member 94*a* is configured to prevent the trip arm 20 from being removed from the base 50. For example, there may be tension present in the flexible member 94*a*.

The process for attaching the trip arm 20 to the base 50 includes inserting the connector 30 of the trip arm 20 into the second opening 58 of the base 50. Once the connector 30 is fully inserted into the second opening 58, the second ring 94*c* is secured to the base ring 96*a* thereby securing the trip arm 20 to the base 50. To unsecure the locking mechanism 90 from the fastener 96, the second ring 94*c* is detached from the base ring 96*a*, and the trip arm 20 is removed from the base 50. In an exemplary embodiment, the trip arm 20 can also be detached from base 50 by detaching the first ring 94*b* from the coupling member 92. Such detachment mechanism, i.e. the locking mechanism 90 and the fastener 96, allows the base 50 to be secured to a rail, e.g., 202, 242, as shown in FIG. 13, while allowing the trip arm 20 to be removed. The detachment mechanism can be advantageous for workers performing maintenance on tracks 200.

For example, in the first night, workers 400 may be performing maintenance, e.g., cleaning the track 200 (which in this example takes two nights to complete). As such, the workers 400 may secure the train trip assembly 11 to the rail 202, in case any runaway trains happen to run on the track 200. The next morning, the train line may be operating normally on track 200. Thus, the workers 400 may simply remove the trip arm 20 (as the trip arm 20 causes any runaway train to automatically activate its brakes) from the base 50. Such action leaves the base 50 secured to the tracks. Thus, the workers 400 do not have to waste time unsecuring the base 50 from the rail 202. The second night (after the next morning), the workers 400 can simply attach the trip arm 20 back to the base 50, and continue cleaning.

Figure 7A:
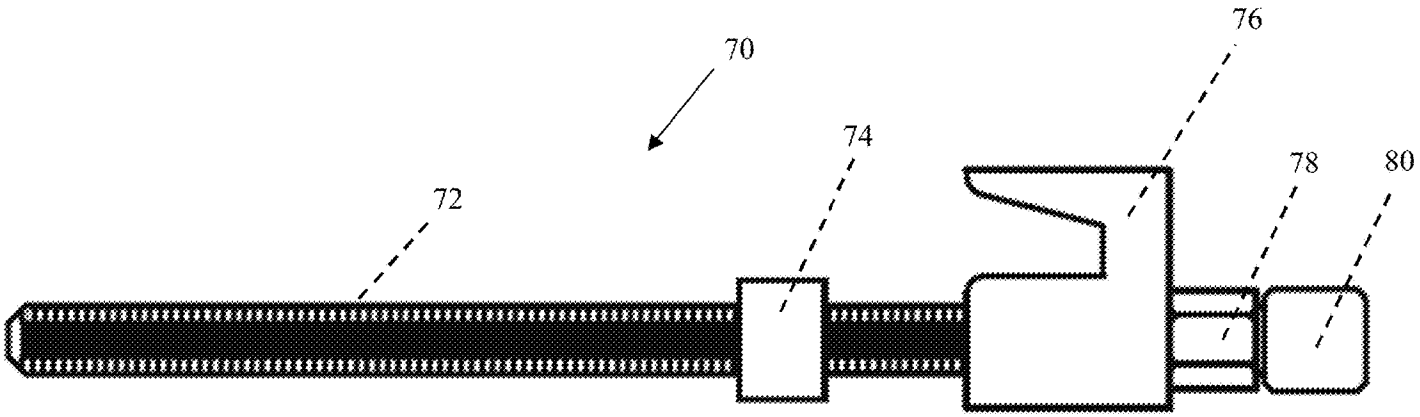
FIG. 7A shows a clamp included in the base of the train trip assembly, according to an embodiment of the present invention.

In addition, as shown in FIG. 7A, the base 50 also includes a clamp 70, which assists in securing the base 50 to the rail 202. To facilitate such securing, the clamp 70 includes at least a fastener 72, a stopper block 74, a wedge slider 76, a hex nut 78 and an adjuster 80. The fastener 72 may, for example, include an externally threaded body, e.g., male thread. Such externally threaded body may include a bolt. In another example, the fastener 72 may be composed entirely of non-conductive fiberglass material. In yet another example, the entire fastener or substantial portion can be disposed within the first opening 56 of the body 52. A portion of the fastener 72 can be securely or permanently held within the first opening 56. For example, the fastener 72 may include an external threaded surface, e.g., male thread. The first opening 56 may include an internal threaded surface. When the fastener 72 is inserted into the first opening 56, the male thread of the fastener 72 interlocks with the female thread of the first opening 56. As such by rotating the fastener 72 in a first direction, the fastener 72 is inserted further into the first opening 56. Likewise, by rotating the fastener 72 in a second direction, the fastener is withdrawn or gradually taken out from being within the first opening 56. The stopper block 74 may include an internal threaded surface, e.g., male thread, that is configured to receive the fastener 72.

Figure 7B:
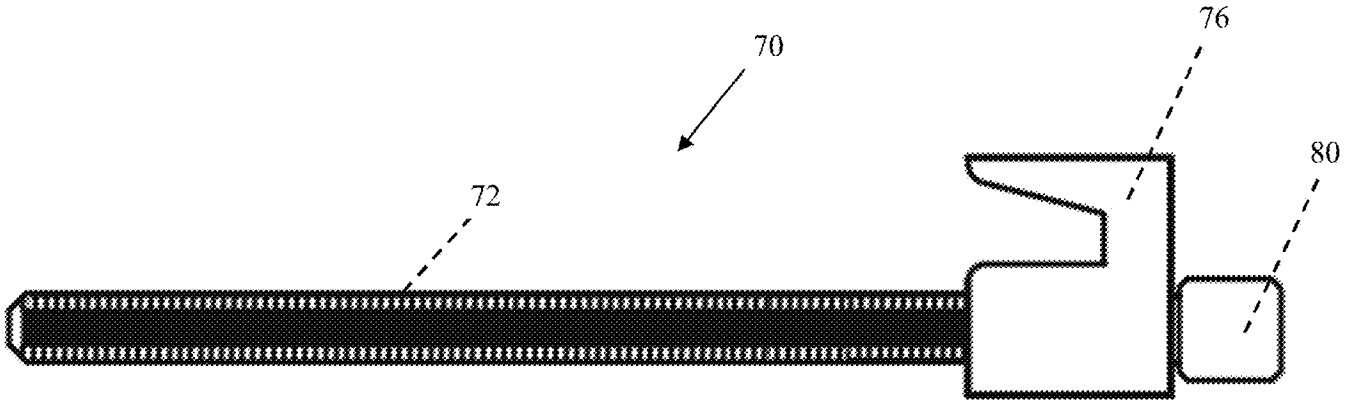
FIG. 7B shows a clamp included in the base of the train trip assembly, according to another embodiment of the present disclosure.

The slider 76 includes a slider cavity 76*a* and an aperture 76*b*. The slider cavity 76*a* includes a flat planar surface 76*a*-1 and a sloped planar surface 76*a*-2. A first end of the flat surface 76*a*-1 is connected to a first end of the sloped surface 76*a*-2 such that an angle is formed between the flat surface 76*a*-1 and the sloped surface 76*a*-2. For example, such angle may be between 10-20 degrees. Preferably, the angle is 14 degrees. Due to such configuration, the slider cavity 76 is able to receive the second portion 208*b* of the foot 208. The aperture 72*b* may have a first end 72*b*-1 and a second end 72*b*-2, and an opening having an interior wall 72*b*-3 that extends from the first end 72*b*-1 to the second end 72*b*-2. For example, the aperture 72*b* may be a through-hole. In another example, the interior of the aperture 72*b* may be a smooth surface. The hex nut 78 includes a first end 78*a* and a second end 78*b*, and an opening that extends from the first end 78*a* to the second end 78*b*. For example, the hex nut 78 may include a through-hole. In another example, the hex nut 78 may be a hexagonal nut. The hex nut 78 may be internally threaded, e.g., female thread. FIG. 7B illustrates another embodiment of the clamp 70 in which the clamp 70 of such embodiment includes a fastener 72, a wedge slider 76 and an adjuster 80.

It should be noted that, in an exemplary embodiment, the trip arm 20, the base 50 and the clamp 70 (including any components therein, as well as screws or fastener that holds the train trip assembly 10 together) may all be composed substantially of non-conductive fiberglass material, such as, for example, FR-4, G10 Fiberglass. As such, when the train trip assembly 10 is attached or secured to a rail, e.g., 202, the train trip assembly 10 does not draw any electricity that may be conducted from a third rail, e.g., 214. Thus, any workers 400 who are installing the train trip assembly 10 will not be indirectly electrocuted by the third rail.

Figure 8:
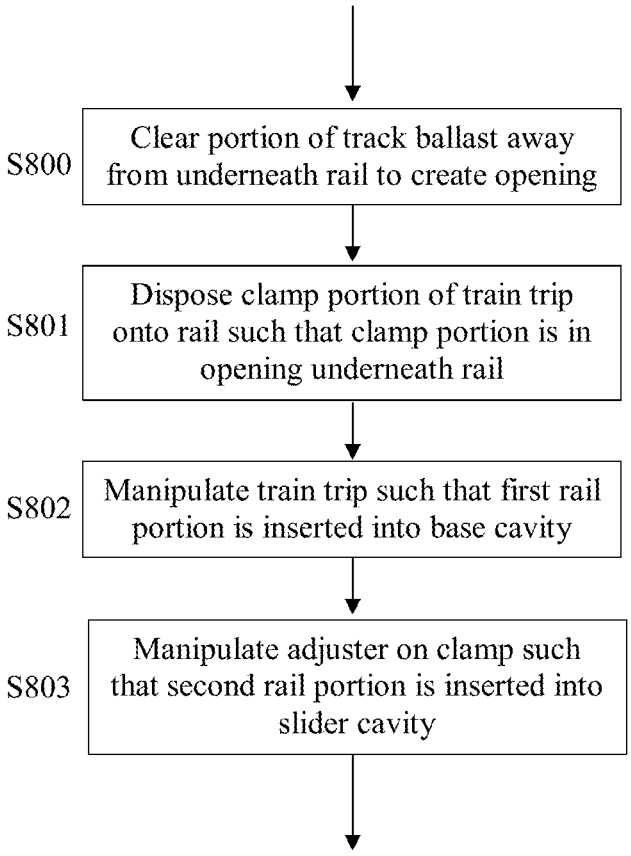
FIG. 8 shows a flow chart of a method that can be performed to lock the train trip assembly to a rail of a track, according to an embodiment of the present invention.
Figure 9:
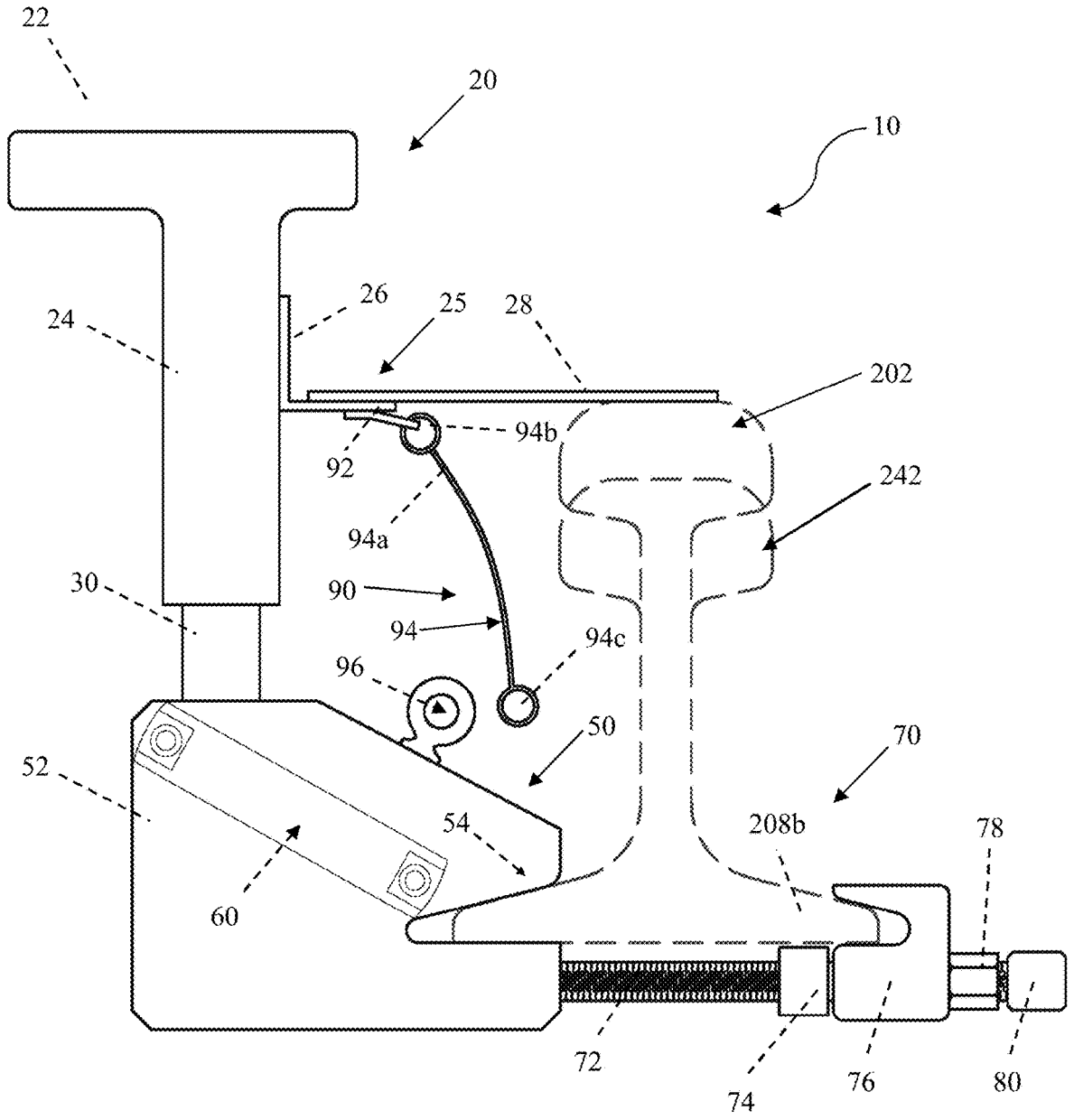
FIG. 9 shows the train trip assembly secured to one of the rails of the track, according to an embodiment of the present invention.

FIG. 8 shows a process or method performed for securing a train trip assembly 10, to a rail 202, according to an exemplary embodiment. To lock the train trip 10 to at least one of the rails 202, a portion of the track ballast 212 is cleared from underneath the rail 202, thereby producing an opening beneath at the rail 202 (step S800). Preferably the portion of the rail 202 to which the train trip 10 is being attached does not include the track ties 210. The remaining portion of the track ballast 212 upholds the rail 202. Next, the train trip 10 is manipulated to allow the clamp 70 to be inserted underneath the rail 202 (step S801). In other words, the clamp 70 is now within the opening previously created by clearing away the track ballast 212. Further, the wedge slider 76, the hex nut 78 and the adjuster 80 are now on the other side of the rail 202. Next, the train trip 10 is then adjusted, i.e. manipulated, such that the first portion 208*a* of the foot 208 enters and is held within the cavity 54 of the body 52 (step S802). Next, the adjuster 80 is operated such that the adjuster 80 causes the slider 76 to move towards the second portion 208*b* of the foot 208 until the second portion 208*b* enters and is held within the cavity 76*a* of the slider 76 (step S803). For example, the fastener 72 may include an external threaded surface, e.g., male thread. The first opening 56 may include an internal threaded surface. When the fastener 72 is inserted into the first opening 56, the male thread of the fastener 72 interlocks with the female thread of the first opening 56. As such by rotating the fastener 72 in a first direction, the fastener 72 is inserted further into the first opening 56. Such rotation may be facilitated by the adjuster 80. Such last step causes the train trip 10 to be secured to the rail 202, as shown in FIG. 9.

Figure 10:
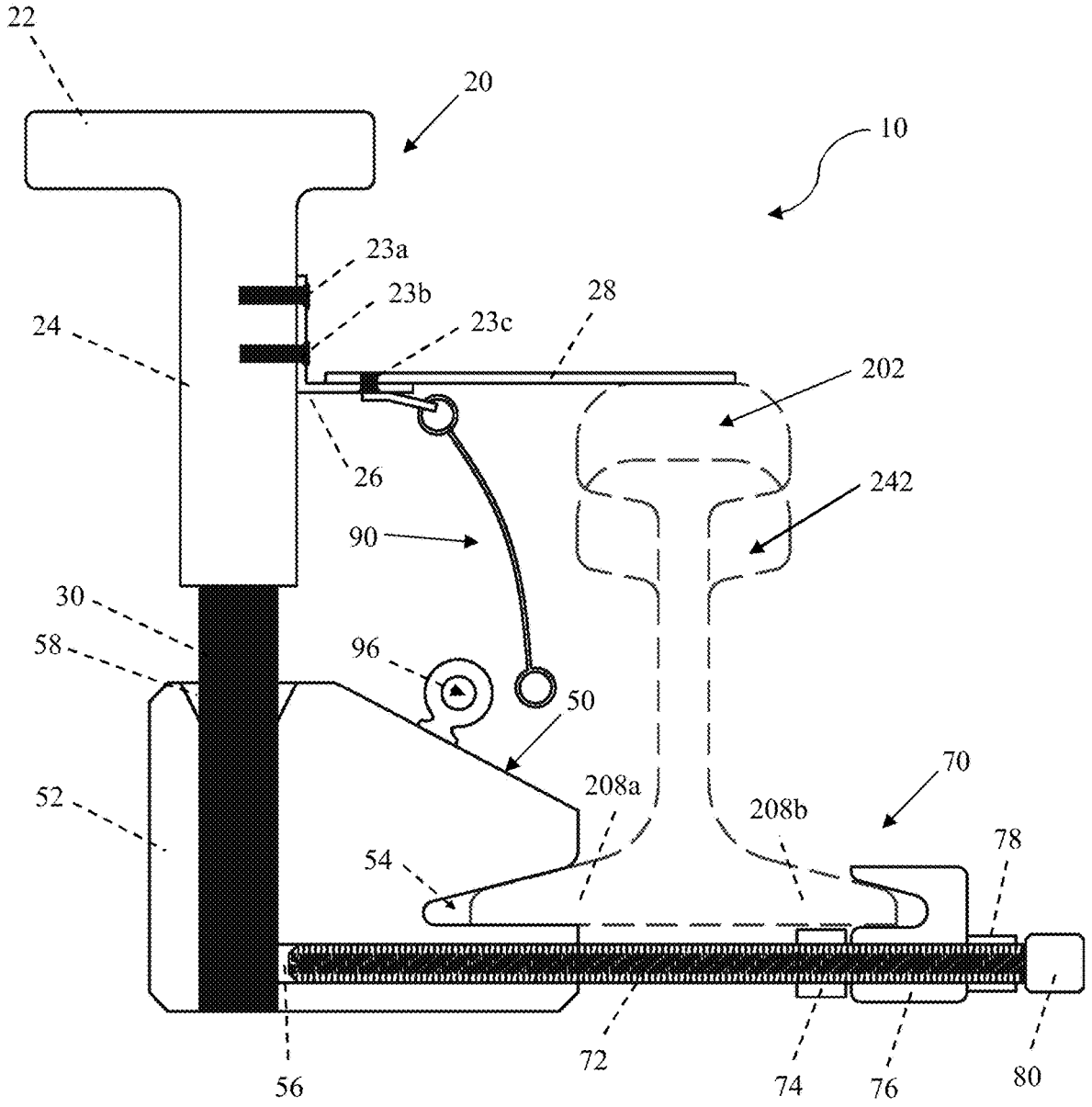
FIG. 10 shows a cross-section of the train trip assembly, according to the embodiment illustrated in FIG. 9.

To remove the train trip 10 from the rail 202, the adjuster 80 is manipulated to release the second portion 208*b* of the foot 208 from the cavity 76*a* of the slider 76. For example, in the case that the fastener 72 includes an external threaded surface and the first opening 56 includes an internal threaded surface, by rotating the fastener 72 in a second direction, the fastener is withdrawn or gradually taken out from being within the first opening 56. Like previously, such rotation may be facilitated by the adjuster 80. After the foot 208*a* is release, the user can take away the train trip assembly 10. It should also be noted that, as shown in FIG. 9, the train trip assembly 10 can be secured to rails of any size. For example, the train trip assembly 10 can be secured to a rail 242, which is shorter in height than the rail 202. FIG. 10 illustrates a cross-section of the train trip 10 in FIG. 9. FIG. 10 illustrates in more detail how the connector 30 of the trip arm 20 is fitted into position within the second opening 58 of the base 50, and how the fastener 72 is fitted in the first opening 56 of the base 50, the stopper block 74 and the slider 76. In addition, FIG. 10 also shows how the first indicator member 26 of the indicator arm 25 is connected to the second elongated member 24 of the trip arm 20, via a fastener 23*a* and a fastener 23*b*. Likewise, the locking mechanism 90 is attached to the first indicator member 26 via a fastener 23*c*.

The aforementioned specific embodiments are illustrative, and many variations can be introduced on these embodiments without departing from the spirit of the disclosure or from the scope of the appended claims. In addition, elements and/or features of different examples, and illustrative embodiments may be combined with each other and/or substituted for each other within the scope of this disclosure and appended claims.

What is claimed is:

1. A train trip assembly for stopping a train comprising a non-conductive trip arm and a non-conductive base, the trip arm configured to contact an actuator of the train moving along a track, and the base including a clamp to secure the assembly to the track, wherein the trip arm and the base substantially prevent the flow of electric current such that the trip arm and the base are not capable of conducting electricity.

2. The train trip assembly according to claim 1, wherein the trip arm includes a first elongated member and a second elongated member having a first end attached to the first elongated member.

3. The train trip assembly according to claim 2, wherein the trip arm includes a connector attached to a second end of the second elongated member and attached to the base.

4. The train trip assembly according to claim 2, wherein the first elongated member includes reflective material disposed thereon.

5. The train trip assembly according to claim 1, wherein the base further includes a first cavity configured to receive a first portion of the track, and a first opening having a first open end and a second closed end.

6. The train trip assembly according to claim 5, wherein the clamp comprises a fastener capable of being secured to the base by the first opening, a slider having a second cavity to receive a second portion of the track and an aperture that permits the slider to be secured to the fastener such that the slider is capable of moving along a longitudinal axis of the fastener and an adjuster for moving the fastener into or out of the first opening of the base.

7. The train trip assembly according to claim 6, wherein the assembly is secured to the track by disposing a first portion of the track into the first cavity of the base and adjusting the fastener such that the second cavity of the slider receives the second portion of the track and thereby locks the assembly to the track.

8. The train trip assembly according to claim 6, wherein the fastener includes an external threaded surface and the first opening of the base includes an internal threaded surface configured to interlock with the external threaded surface.

9. The train trip assembly according to claim 6, wherein rotation of the fastener in a first direction allows the fastener to be inserted further into the first opening and rotation of the fastener in a second direction allows the fastener to be withdrawn from the first opening.

10. A method for automatically stopping a train moving along a track, the method comprising:

providing a train trip assembly comprising a non-conductive trip arm and a non-conductive base, the trip arm configured to contact an actuator of the train moving along the track to stop the train, and the base including a clamp for securing the assembly to the track, wherein the trip arm and the base substantially prevent the flow of electric current such that the trip arm and the base are not capable of conducting electricity; and securing the train trip assembly to the track.

11. The method according to claim 10, wherein the trip arm includes a first elongated member and a second elongated member having a first end attached to the first elongated member.

12. The method according to claim 11, wherein the trip arm includes a connector attached to a second end of the second elongated member and attached to the base.

13. The method according to claim 11, wherein the first elongated member includes reflective material disposed thereon.

14. The method according to claim 10, wherein the base further includes a first cavity configured to receive a first portion of the track, and a first opening having a first open end and a second closed end.

15. The method according to claim 14, wherein the clamp comprises a fastener capable of being secured to the base by the first opening, a slider having a second cavity to receive a second portion of the track and an aperture that permits the slider to be secured to the fastener such that the slider is capable of moving along a longitudinal axis of the fastener and an adjuster for moving the fastener into or out of the first opening of the base.

16. The method according to claim 15, wherein the step of securing the train trip assembly to the track comprises:

disposing a first portion of the track into the first cavity of the base; and operating the adjuster to adjust the fastener such that the second cavity of the slider receives the second portion of the track, thereby locking the train trip assembly to the track.

17. The method according to claim 15, wherein the fastener includes an external threaded surface and the first opening of the base includes an internal threaded surface configured to interlock with the external threaded surface.

18. The method according to claim 15, wherein rotation of the fastener in a first direction allows the fastener to be inserted further into the first opening and rotation of the fastener in a second direction allows the fastener to be withdrawn from the first opening.

19. The train trip assembly according to claim 1, wherein the non-conductive trip arm or the non-conductive base comprises fiber-reinforced plastic.

20. The method according to claim 10, wherein the non-conductive trip arm or the non-conductive base comprises fiber-reinforced plastic.

* * * * *